US012535307B2

(12) United States Patent
Fellows et al.

(10) Patent No.: US 12,535,307 B2
(45) **Date of Patent: *Jan. 27, 2026**

(54) FIREARM BARREL

(71) Applicant: Franklin Armory Holdings, Inc., Minden, NV (US)

(72) Inventors: Ryan Paul Fellows, Hollister, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/233,953

(22) Filed: Jun. 10, 2025

(65) Prior Publication Data

US 2025/0305805 A1 Oct. 2, 2025

Related U.S. Application Data

(63) Continuation of application No. 16/377,224, filed on Apr. 7, 2019, which is a continuation of application (Continued)

(51) Int. Cl.
*F41A 21/18* (2006.01)
*F41A 21/24* (2006.01)

(Continued)

(52) U.S. Cl.
CPC ..... *F42B 10/06* (2013.01); *F41A 21/18* (2013.01); *F41A 21/24* (2013.01); *F42B 5/025* (2013.01);

(Continued)

(58) Field of Classification Search
CPC ..... F41A 21/18
See application file for complete search history.

(56) References Cited

U.S. PATENT DOCUMENTS 3,434,425 A 3/1969 Crichter
3,643,599 A 2/1972 Hubich (Continued)

OTHER PUBLICATIONS

Verney-Carron, "Hastings," http://www.hastingsbarrels.com/, (c) 2011, accessed Jul. 12, 2018.

(Continued)

*Primary Examiner* — J. Woodrow Eldred
(74) *Attorney, Agent, or Firm* — Bennet K. Langlotz; Langlotz Patent & Trademark Works, LLC

(57) ABSTRACT

A firearm barrel has an elongated body defining a bore and defining a bore axis, the body defining a breech end and an opposed muzzle end, a chamber defined in the breech end and contiguous with the bore; the bore having an interior surface having a plurality of alternating lands and grooves, the grooves being surfaces separated from the bore axis by first radius, the lands being surfaces separated from the bore axis by second radius less than the first radius and the lands and grooves being straight elements parallel to the bore axis, such that no spin is imparted to a projectile propelled down the bore. The lands and grooves may extend from the chamber to the muzzle end. The bore may have a constant cross-sectional profile along its length.

12 Claims, 8 Drawing Sheets

Related U.S. Application Data

No. 16/054,862, filed on Aug. 3, 2018, now Pat. No. 10,295,290.

(60) Provisional application No. 62/619,365, filed on Jan. 19, 2018, provisional application No. 62/541,994, filed on Aug. 7, 2017.

(51) Int. Cl.

| | |
|---|---|
| ***F42B 5/02*** | (2006.01) |
| ***F42B 10/06*** | (2006.01) |
| ***F42B 10/08*** | (2006.01) |
| ***F42B 14/06*** | (2006.01) |

(52) U.S. Cl.

CPC ..... *F42B 10/08* (2013.01); *F42B 14/061* (2013.01); *F42B 14/062* (2013.01)

(56) References Cited

U.S. PATENT DOCUMENTS

| | | | | |
|---|---|---|---|---|
| 3,880,083 | A | 4/1975 | Wasserman | |
| 5,622,335 | A | 4/1997 | Trouillot | |
| 6,443,391 | B1 | 9/2002 | Malejko | |
| 6,454,205 | B2 | 9/2002 | Niemeyer | |
| 9,677,863 | B1 | 6/2017 | Palathingal et al. | |
| 10,295,290 | B2 * | 5/2019 | Fellows | F41A 21/18 |
| 2003/0037475 | A1 * | 2/2003 | Juan | F41A 21/18 42/78 |
| 2005/0183613 | A1 * | 8/2005 | Huffman | F42B 12/40 102/444 |
| 2009/0013892 | A1 | 1/2009 | Judson | |

OTHER PUBLICATIONS

Nathanial F, "Future Firearms Ammunition Technology 003: Sabots—Performance-Enhancing Shoes for Your Bullets," https://www.thefirearmblog.com/blog/2016/08/29/future-firearms-ammunition-technology-003-sabots-performance-enhancing-shoes-bullets/, Aug. 29, 2016, accessed Jul. 19, 2018.

wikipedia.org, "M829," https://en.wikipedia.org/wiki/M829, last edited Jul. 11, 2018, accessed Jul. 19, 2018.

Midwayusa, Inc., "H&N Hunting Sampler Air Gun Pellets 22 Caliber 5 Types," https://www.midwayusa.com/product/831302/h-and-n-hunting-sampler-air-gun-pellets-22-caliber-5-types, (c) 2018, accessed Jul. 19, 2018.

* cited by examiner

FIREARM BARREL

CROSS-REFERENCE TO RELATED APPLICATION

This application is a Continuation of U.S. patent application Ser. No. 16/377,224 filed on Apr. 7, 2019, entitled "FIREARM BARREL," which is a Continuation of U.S. patent application Ser. No. 16/054,862 filed on Aug. 3, 2018 now issued as U.S. Pat. No. 10,295,290, entitled "FIREARM BARREL," which claims the benefit of U.S. Provisional Patent Application No. 62/541,994 filed on Aug. 7, 2017, entitled "SELF-STABILIZED PROJECTILES," and claims the benefit of U.S. Provisional Patent Application No. 62/619,365 filed on Jan. 19, 2018, entitled "NON-RIFLE/SHOTGUN (NRS) FIREARM SYSTEM," which are hereby incorporated by reference in their entirety for all that is taught and disclosed therein.

FIELD OF THE INVENTION

The present invention relates to barrels for projectile weapons and, more particularly, to a firearm barrel featuring straight cut lands and grooves.

BACKGROUND OF THE INVENTION

The National Firearms Act of 1934 (NFA) requires the registration with the federal government of machineguns, rifles and shotguns having an overall length less than 26 inches, rifles with a barrel shorter than 16 inches, and shotguns with a barrel length less than 18 inches. An example of a prior art short barreled rifle is shown in FIG. 1. Short barreled rifles are appealing for interior home defense and other close quarters battle applications where a longer barrel could be difficult to maneuver or easily snagged. The NFA definition of a rifle includes a "rifled barrel," and the NFA definition of a shotgun includes a "smooth bore." Similarly, many state "assault weapon" regulations define an assault weapon as having either a smoothbore or rifled barrel. Thus, an opportunity exists to create a firearm that does not meet the legal definition of a rifle or a shotgun, making it not subject to these federal or state regulations.

An example of a firearm technology that is not classified as a pistol, rifle, or shotgun by the NFA is a firearm having a barrel with straight cut lands and grooves. In the 1870s, Husqvarna Vapensfabrik of Sweden made shotguns with this feature. Verney-Carron SA of makes shotgun barrels with straight cut lands and grooves sold under the Hastings brand name. Briley of Houston, TX makes straight cut choke tubes. Roughly five hundred years ago, muzzle loading barrel manufacturers originally made straight cut lands and grooves with the intent of depositing carbon in the bore to allow for more shots before needing to clean. This eventually led to the rifle with spiral cut barrels. Soon after, the straight cut barrels were abandoned in favor of the other technology. The only reason Swedish shotguns had this design was so they could be used to hunt in the King's forest (who declared that smooth bore weapons could not be used.) The reason why Hastings and Briley use straight cut land and groove shotgun components is to keep the wads from spinning and therefore keeping the shot column moving forward with less dispersion from angular momentum upon exiting the muzzle. Except for this specialized usage, barrels with straight cut lands and grooves have been viewed as an obsolete firearms technology because of the increased projectile velocity and accuracy resulting from rifles. Furthermore, a barrel with straight cut lands and grooves has never been used with a modern breech-loading, metallic cartridge.

Therefore, a need exists for a new and improved firearm barrel with straight cut lands and grooves that enables the user to have a short-barreled firearm with a stock that is not subject to the National Firearms Act. In this regard, the various embodiments of the present invention substantially fulfill at least some of these needs. In this respect, the firearm barrel according to the present invention substantially departs from the conventional concepts and designs of the prior art, and in doing so provides an apparatus primarily developed for the purpose of providing a short-barreled firearm with a stock that is not subject to the National Firearms Act.

SUMMARY OF THE INVENTION

The present invention provides an improved firearm barrel, and overcomes the above-mentioned disadvantages and drawbacks of the prior art. As such, the general purpose of the present invention, which will be described subsequently in greater detail, is to provide an improved firearm barrel that has all the advantages of the prior art mentioned above.

To attain this, the preferred embodiment of the present invention essentially comprises an elongated body defining a bore and defining a bore axis, the body defining a breech end and an opposed muzzle end, a chamber defined in the breech end and contiguous with the bore; the bore having an interior surface having a plurality of alternating lands and grooves, the grooves being surfaces separated from the bore axis by first radius, the lands being surfaces separated from the bore axis by second radius less than the first radius and the lands and grooves being straight elements parallel to the bore axis, such that no spin is imparted to a projectile propelled down the bore. The lands and grooves may extend from the chamber to the muzzle end. The bore may have a constant cross-sectional profile along its length. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
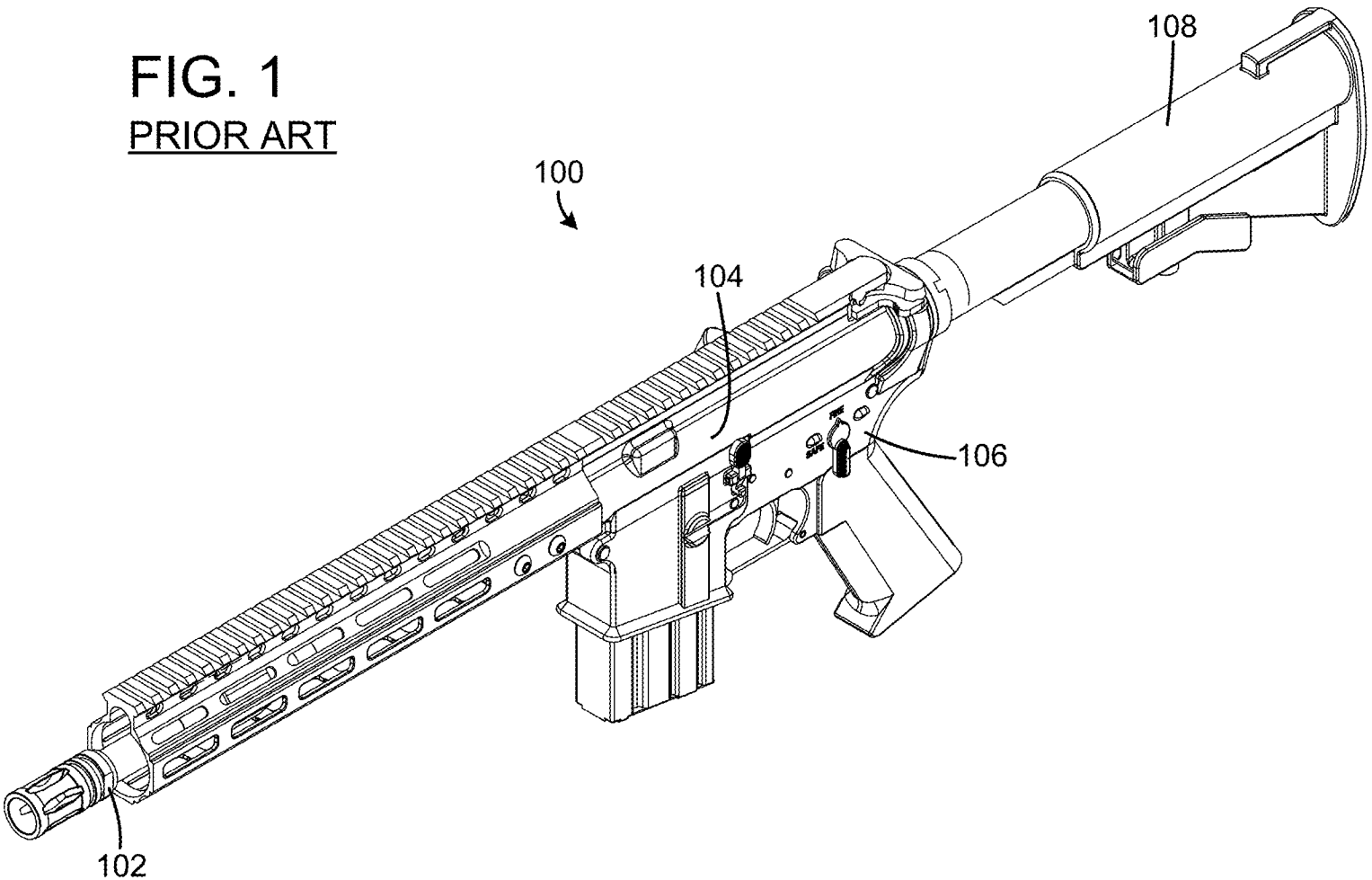
FIG. 1 PRIOR ART
FIG. 1 is a front isometric view of a prior art short barreled rifle subject to regulation by the National Firearms Act.

An embodiment of the firearm barrel of the present invention is shown and generally designated by the reference numeral 10.

Figure 2:
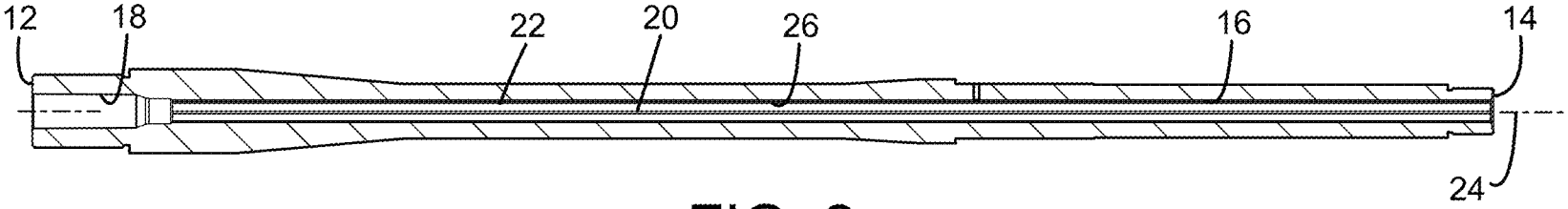
FIG. 2 is a side sectional view of the current embodiment of the firearm barrel constructed in accordance with the principles of the present invention.
Figure 4:
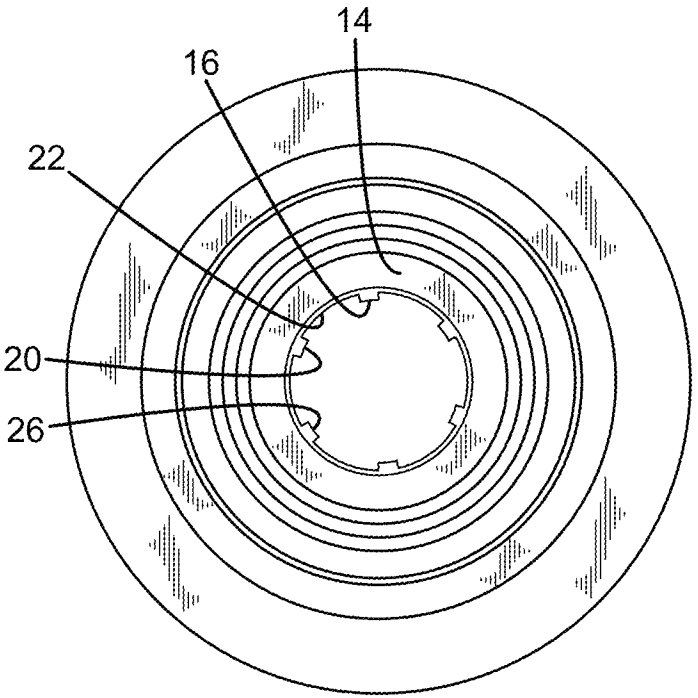
FIG. 4 is a front view of the current embodiment of the firearm barrel of FIG. 2.
Figure 3:
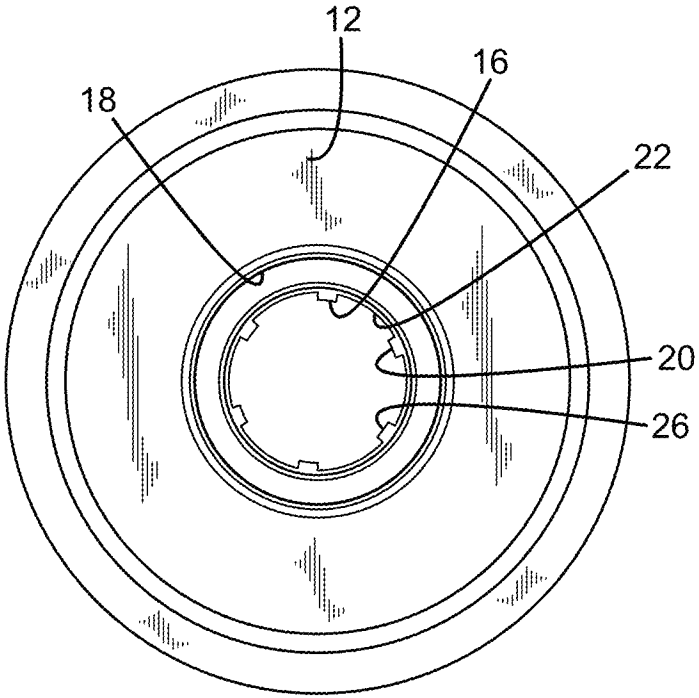
FIG. 3 is a rear view of the current embodiment of the firearm barrel of FIG. 2.
Figure 5:
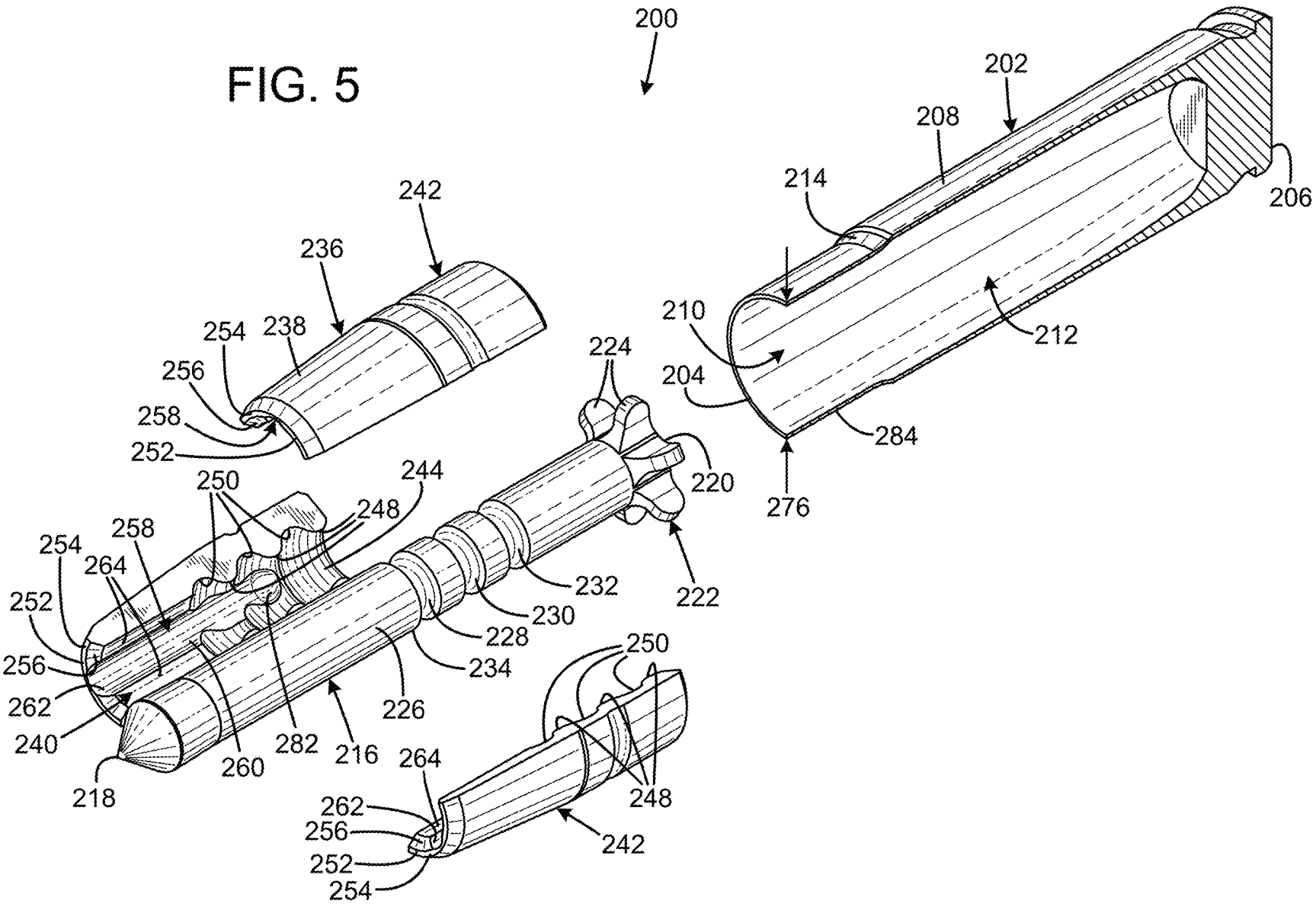
FIG. 5 is an exploded view of the current embodiment of a firearm cartridge constructed in accordance with the principles of the present invention and suitable for use with the firearm barrel of FIG. 2.
Figure 6:
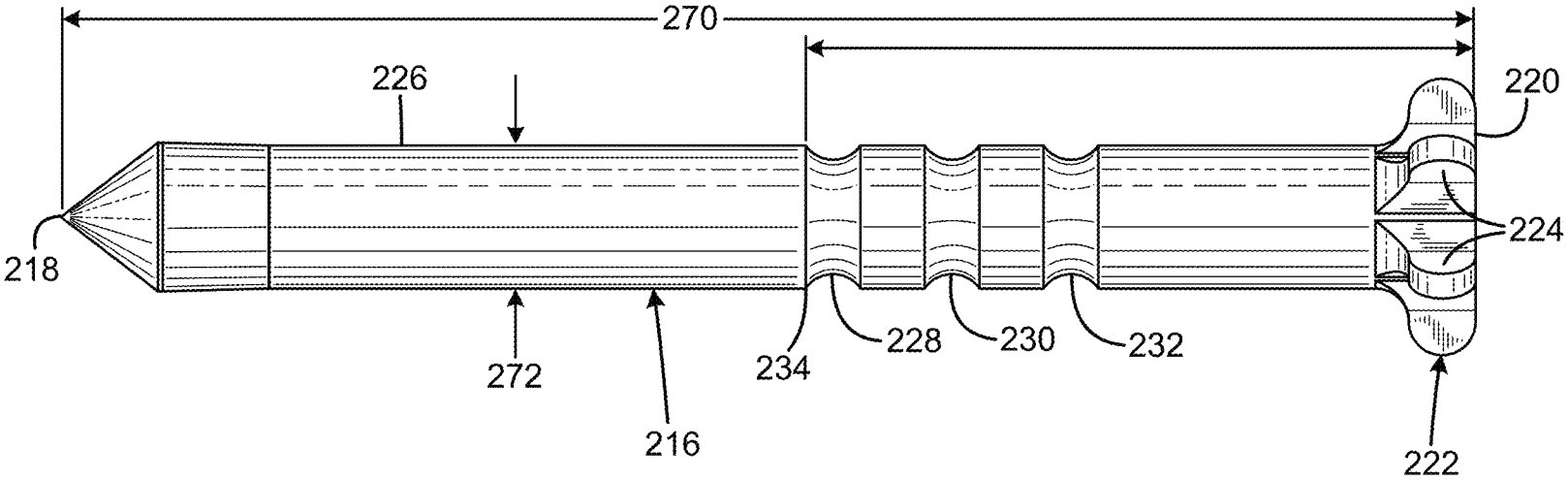
FIG. 6 is a left side view of the projectile of FIG. 5 removed from the firearm cartridge.

FIGS. 2-4 illustrate the improved firearm barrel 10 of the present invention. More particularly, the firearm barrel is an elongated body having a rear/breech end 12 and an opposed muzzle end 14. The barrel defines a barrel bore 16, which communicates with a chamber 18 in the rear end, and a barrel axis 24. In the current embodiment, the barrel is chambered to receive a .308 Winchester cartridge. However, the barrel can be chambered for any suitable cartridge, including 300 Blackout and 5.56 mm. The entire barrel bore forward of the chamber has an interior surface 26 having a plurality of alternating lands 20 and grooves 22 (the lands and grooves extend from the chamber to the muzzle end, giving the bore a constant cross-sectional profile along its length). The grooves are surfaces separated from the bore axis by a first radius. The lands are surfaces separated from the bore axis by a second radius less than the first radius. In the current embodiment, there are six straight lands and six straight grooves with a 0.300 inch bore diameter and a 0.308 inch groove diameter. The grooves are each 0.123+0.002/−0.000 inch wide with no twist to provide a minimum bore and groove area of 0.0736 sq. in. However, the barrel bore can have a diameter of between 0.17 inch and 0.50 inch depending on what size cartridge the barrel is chambered to receive. The chamber is sized to centerfire cartridge having a bottlenecked case, but can also be sized to receive a rimfire cartridge.

The lands 20 and grooves 22 are straight elements parallel to the bore axis in the current invention, such that no spin is imparted to a projectile (not shown) propelled down the barrel bore 16. However, compared to propelling an identical projectile down a smoothbore barrel (not shown), the lands and grooves prevent yawing of the projectile within the firearm barrel 10. Deforming the projectile with the lands also has the benefit of creating a known pressure profile. There is no evidence the straight lands and grooves decrease the velocity of a projectile propelled through the firearm barrel 10 compared to a conventional rifled barrel. While the accuracy of a projectile propelled through the firearm barrel 10 can be decreased compared to the accuracy of a projectile propelled through the conventional short barreled rifle 100 shown in FIG. 1, 5.56 mm rounds are still accurate to within 3 to 4 MOA at 50 yards, which is sufficient for interior home defense and other close quarters battle applications. Conventional 300 Blackout ammunition is accurate to within 3 MOA at 100 yards. The ammunition is relatively accurate given the 11.5 inch length of the firearm barrel 10, but the projectiles are unstable and prone to tumbling in flight. As a result, the projectiles may hit the target sideways.

It should be appreciated that the firearm barrel 10 is adapted to be attached to a conventional firearm frame/upper receiver to form a complete firearm that is not subject to regulation by the National Firearms Act even if the length of the firearm barrel 10 is less than 16 inches, or the complete firearm has a total length less than 26 inches. For example, the firearm barrel 10 can be substituted for the conventional short rifle barrel 102 shown in FIG. 1 and used with the conventional upper receiver 104, lower receiver 106, and stock 108 also shown in FIG. 1 to form a complete firearm.

In some applications of the firearm barrel 10, much greater accuracy than 3 MOA at 100 yards is required. In these circumstances, a firearm cartridge 200 including a drag-stabilized projectile 216 is highly desirable. Moreover, the straight lands 20 and grooves 22 of the firearm barrel 10 enable finned and flared ammunition to be fired in a stable fashion. The rifled bore of a conventional short barreled rifle 100 would be unsuitable for this purpose because the rifling would destabilize a projectile that was designed to be spin stabilized. A smoothbore barrel would also destabilize a projectile that was designed to be spin stabilized. Furthermore, the firearm barrel 10 does not lose any of the energy from discharge by spinning the projectile within the firearm barrel 10. Instead, all the energy of discharge can used to propel the projectile in a linear fashion at a higher velocity, which is believed to provide the projectile with superior penetrative properties upon encountering a target, and/or with less barrel wear.

FIGS. 5-8 illustrate the improved firearm cartridge 200 and projectile 216 of the present invention. More particularly, the firearm cartridge is sized for use in a barrel chambered in 300 Blackout in the current embodiment. The firearm cartridge includes a case 202 having a front 204, rear 206, and exterior 208. The front defines a case mouth 210 that communicates with an interior chamber 212 and a neck 284. The exterior includes a bottlenecked portion 214 located below the case mouth.

An elongated projectile 216 having a tapered forward end 218 and a rear end 220 has the rear end received within the interior chamber 212 of the case 202. The projectile includes a stabilizer 222 at the rear end, which is a plurality of fins 224 in the current embodiment. The exterior 226 of the projectile defines a first circumferential groove 228, second circumferential groove 230, and third circumferential groove 232. The three circumferential grooves are all located between the forward end and the rear end of the projectile. The first circumferential groove is located at an intermediate portion 234, and the second and third circumferential grooves are located rearward of the first circumferential groove.

A sabot assembly 236 has an exterior 238 sized to be closely received in the case mouth 210 and defines an interior passage 240 adapted to closely receive the projectile 216. The sabot assembly includes a plurality of identical elements/petal segments 242 that are arranged about the projectile. In the current embodiment, the sabot assembly has three petal segments, but any suitable number of segments could be used. Each petal segment has an interior 244 that defines a plurality of mating features 246 adapted to engage the circumferential grooves 228, 230, 232 on the projectile to limit axial motion of the projectile with respect to the sabot assembly. In the current embodiment, the mating features are ridges 248 and grooves 250. Each petal segment has a forward rim 252 that is spaced apart from the projectile. Each petal segment has a forward end portion 254 that encompasses the projectile and includes a tapered groove 256 that defines a gap with respect to the projectile. Each petal segment defines a linear channel 258 parallel to the length of the projectile. In the current embodiment, the linear channel has a semi-cylindrical surface 260 and an open forward end 262. The linear channel separates opposed and elongated contact surfaces 264 adapted to contact the projectile.

In the current embodiment, the projectile 216 has a length 270 of 1.485 inch and the intermediate portion 234 is located at the midpoint of the projectile. The projectile has a diameter 272 of 0.150 inch over the majority of the projectile's length. The linear channels 258 of the petal segments 242 have a length 274 greater than the length of the projectile. The linear channels of the petal segments also have a length greater than the diameter of the projectile and the diameter 276 of the case mouth 210. The linear channels also have a length that is at least half the length 280 of each petal segment. The centers of the circumferential grooves 228, 230, 232 are separated from one another by 0.125 inch. The center of circumferential groove 228 is located 0.810 inch from the tapered forward end 218 of the projectile. The circumferential grooves 228, 230, 232 reduce the diameter of the projectile to 0.120 at their centers. The tapered forward end has a length of 0.101 inch. The diameter of the projectile at the base of the tapered forward end flares slightly to 0.156 inch compared to the diameter of the remainder of the projectile's length. The fins 224 have a diameter of 0.290 inch that is less than the diameter of the straight lands 20 of the firearm barrel 10 (0.300 inch). The fins are 0.070 inch wide. The sabot assembly 236 has a diameter that is large enough to engage the straight lands of the firearm barrel 10, which prevents the saboted projectile from slightly rotating under launch conditions. Unlike conventional spin-stabilized projectiles, fin stabilized projectiles like projectile 216 are negatively influenced by rotating in flight since it increases yaw and instability. By not inducing spin on the projectile 216, the firearm barrel 10 makes the projectile more accurate than it would be if fired from a conventional rifled firearm barrel 102.

Figure 7:
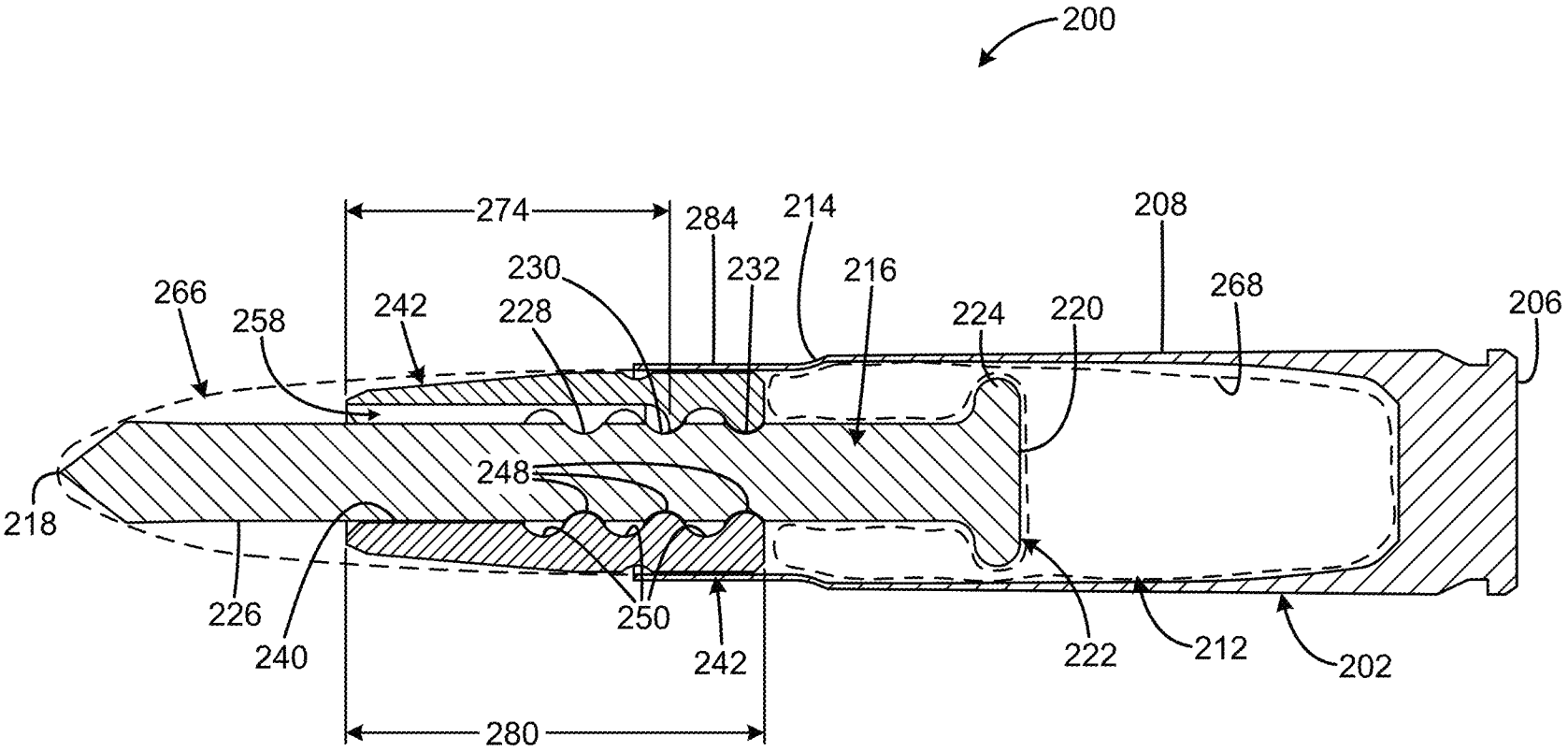
FIG. 7 is a left side sectional view of the firearm cartridge of FIG. 5 in the assembled state. The dashed lines at the nose show a conventional bullet profile.
Figure 8:
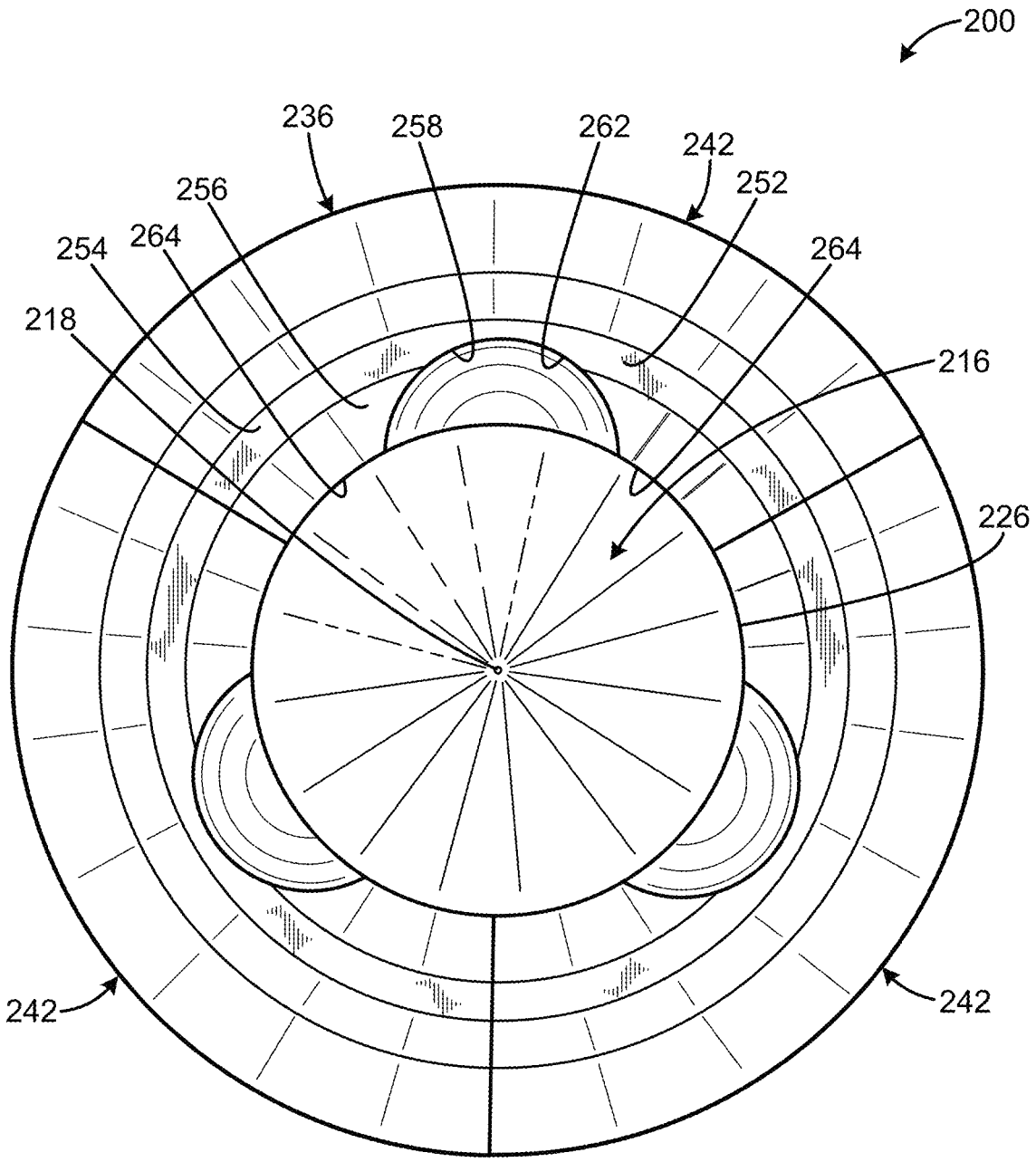
FIG. 8 is a front view of the firearm cartridge of FIG. 5 in the assembled state.

In FIG. 7, the dashed lines 266 show a conventional bullet profile relative to the forward end 218 of the projectile 216. The dashed lines 268 show powder that is received within the interior chamber 212 of the case 202. A portion of the powder surrounds the rear end 220 of the projectile, including the fins 224.

Figure 9:
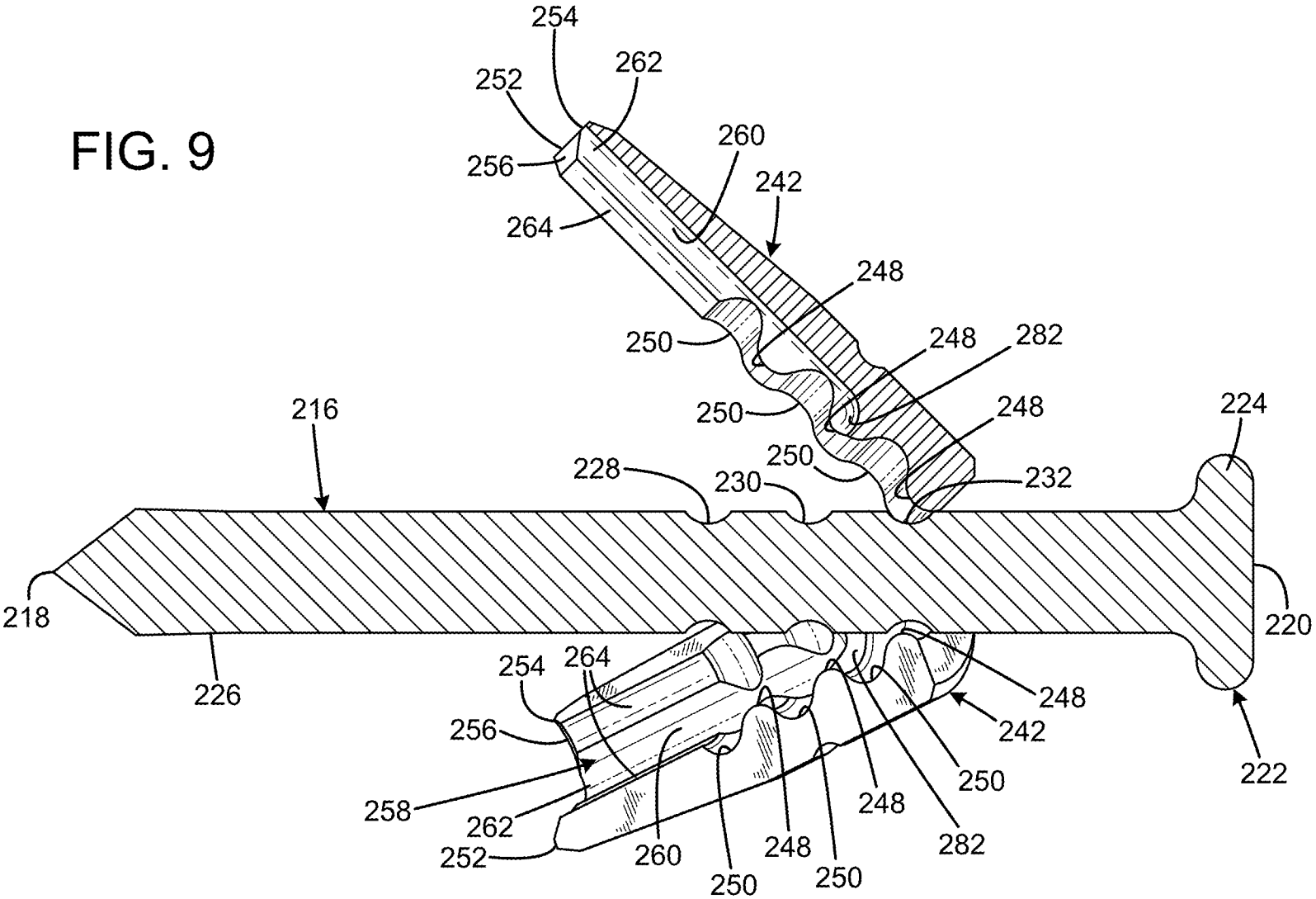
FIG. 9 is a right side sectional view of the projectile and sabot of FIG. 5 with the sabot in the process of separating from the projectile during flight.

FIG. 9 illustrates the improved projectile 216 and sabot assembly 236 in flight. After the projectile and sabot assembly exit the muzzle end 14 of the firearm barrel 10, the forward rims 252 of the petal segments 242 act as air wedges because the forward rims are chamfered inward and peel the petal segments away from the projectile. Wind resistance also creates a pressure wave down the length of the linear channels 258, which then spreads laterally at the blind rear ends 282 of the linear channels to spread the interiors 244 of the petal segments away from the exterior 226 of the projectile without affecting the flight of the projectile. The separation of the petal segments without affecting the flight of the projectile is believed to increase accuracy of the projectile. The ridges 248 of the petal segments are concave/toroidal with concave mating surfaces that provide a hinging relationship with the circumferential grooves 228, 230, 232. Eventually, these effects combine to separate the petal segments from the projectile, which then flies unencumbered to its target.

The circumferential grooves 228, 230, 232 are all positioned either at or behind the longitudinal midpoint/intermediate portion 234 of the projectile 216 because the circumferential grooves add drag during flight. Because of their position, the circumferential grooves add drag only to the rear half of the projectile, thereby preserving or increasing the projectile's drag-induced aerodynamic stability. If any of the circumferential grooves were located on the front half of the projectile, they would instead impart acrodynamic instability to the projectile. The fins 224 also provide rear drag that keeps the forward end 218 of the projectile pointed forward during flight. This combination of elements moves the center of pressure rearward of the projectile's center of gravity, which is believed to enable the projectile to be launched without experiencing inaccuracy issues associated with transonic flight instability. The circumferential grooves are also located where they are to lock in the petal segments 242 at the case neck 284. To maximize the powder capacity in the interior chamber 212 of the case 202 to result in the highest possible muzzle velocity of the projectile, the circumferential grooves are also located to ensure that as much of the projectile as possible is located outside the case mouth while still fitting within a conventional cartridge profile required to fit in a standard magazine. In addition, the sabot assembly 236 has a shorter overall length than the projectile. By having a shorter overall length, the projectile can be seated in the case to the normal specified seating depth without impinging on the case's powder capacity.

It should be appreciated that the firearm cartridge 200, using a conventional 300 Blackout case 202 with regular powder 268 and a regular primer (not shown), results in the projectile 216 fired through the firearm barrel 10 achieving sub-MOA accuracy. In testing, the projectile has produced five shot groups of less than 1 inch at 100 yards. This exceeds the accuracy achieved by conventional bullets fired from Blackout 300 cartridges and propelled through a conventional rifled firearm barrel 102 measuring 11.5 inches, as well as the accuracy of most AR-type rifles.

Figure 10:
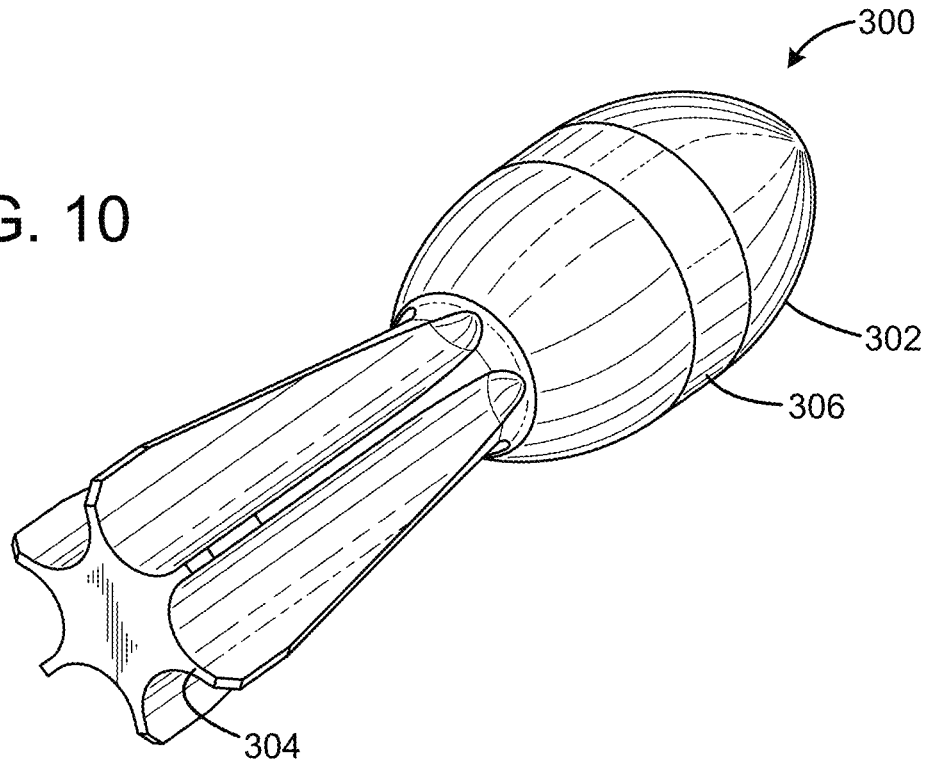
FIG. 10 is a rear isometric view of a first alternative embodiment of a projectile suitable for use with the firearm barrel of FIG. 2.

FIG. 10 illustrates a first alternative embodiment of the improved projectile 300. More particularly, the projectile 300 has a bulbous, forward weighted front half 302 and a lighter, drag-inducing finned tail rear half 304. The overall diameter of the front and rear halves are substantially similar with the rear half being no larger than the front half. The front half has a drive band 306 that is sized so the projectile will obturate when it encounters the straight lands 20 and grooves 22 of the rifle barrel 10 to increase pressure.

In the current embodiment, the projectile 300 has a length of 1.224 inch. The distance from the front of the front half 302 to the drive band is 0.298 inch. The driveband has a length of 0.1 inch and a diameter of 0.308 inch, which is greater than the diameter of the straight lands 20 of the firearm barrel 10 (0.300 inch). The diameter of the forward-most portion of the finned tail rear half 304 is 0.158 inch. The distance from the front to the location where the finned tail rear half begins to flare outward from the front half 302 is 0.644 inch. The maximum diameter of the finned tail rear half is 0.301 inch.

Figure 11:
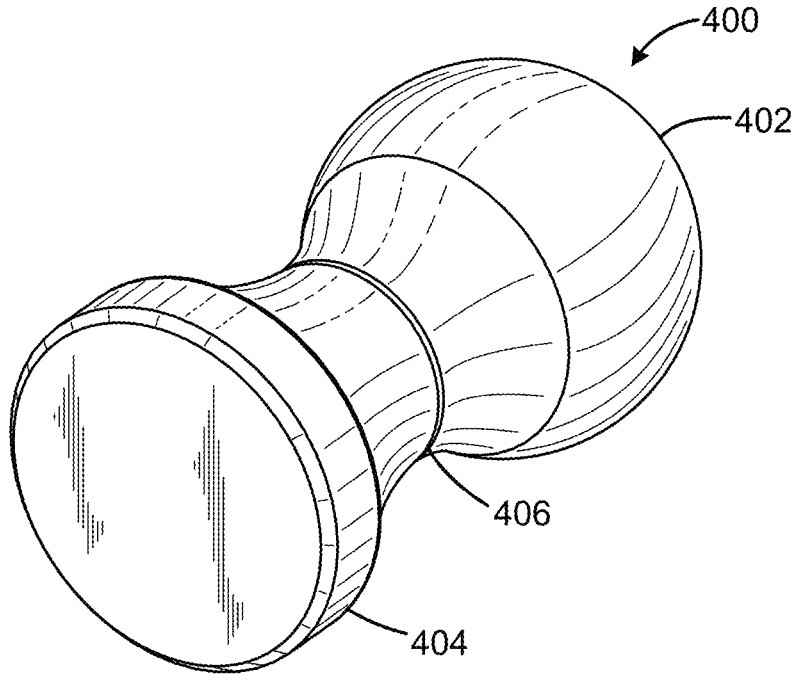
FIG. 11 is a rear isometric view of a second alternative embodiment of a projectile suitable for use with the firearm barrel of FIG. 2.

FIG. 11 illustrates a second alternative embodiment of the improved projectile 400. More particularly, the projectile 400 has a bulbous, forward weighted front half 402 and a lighter, drag-inducing revolved radius face rear half 404. The front and rear halves are joined by a neck portion 406. The overall diameter of the front and rear halves is substantially similar with the rear half being no larger than the front half. The front half has a diameter that is sized so the projectile will obturate when it encounters the straight lands 20 and grooves 22 of the rifle barrel 10 to increase pressure.

In the current embodiment, the projectile 400 has a length of 0.598 inch. The maximum diameter of the front half 402 is 0.308 inch, which is greater than the diameter of the straight lands 20 of the firearm barrel 10 (0.300 inch). The distance from the front of the front half 402 to the narrowest portion of the neck portion 406 is 0.356 inch. The narrowest portion of the neck portion 406 has a diameter of 0.179 inch, which is maintained over a distance of 0.007 inch. The distance from the front of the front half 402 to the forward-most portion of the rear half 404 is 0.534 inch. The rear half 404 has a maximum diameter of 0.308 inch, which is greater than the diameter of the straight lands 20 of the firearm barrel 10 (0.300 inch).

The projectiles 300, 400 attain their aerodynamic stability by intentionally biasing the mass toward the front half of the projectile and intentionally biasing the drag toward the rear half of the projectile. The front half possesses more mass than the rear half, and therefore is the main body of the projectile. The main body has a slope to the front the decreases aerodynamic drag and a portion behind the slope that extends for some distance before reducing to a significantly smaller diameter portion in the rear half of the projectile called the tail. As is exemplified by projectiles 300, 400, the tail is a means of drag such as a set of fins, ribs, or a revolved radius face. Unlike prior art drag-stabilized projectiles, the drag features do not extend past the limits of the main body of the projectile. The projectiles therefore have a profile such that they can be launched accurately from the firearm barrel 10 without the assistance of a sabot assembly, which decreases manufacturing cost, especially if they can be of unitary construction from a single material. Furthermore, the projectiles have a mass comparable to commonly marketed spin-stabilized projectiles of the same caliber and fit as a direct replacement for a spin-stabilized projectile into existing firearm cartridge designs for spins-stabilized projectiles.

While a current embodiment of a firearm barrel has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm barrel comprising:

an elongated body defining a bore and defining a bore axis;

the elongated body defining a breech end and an opposed muzzle end;

a chamber defined in the breech end and contiguous with the bore;

the elongated body having a length of less than 18 inches;

wherein the chamber is sized to receive ammunition having a central primer registered with the bore axis;

the bore having an interior surface having a plurality of alternating lands and grooves;

the grooves being surfaces separated from the bore axis by first radius;

the lands being surfaces separated from the bore axis by second radius less than the first radius; and the lands and grooves being straight elements parallel to the bore axis, such that no spin is imparted to a projectile propelled down the bore.

2. The firearm barrel of claim 1 wherein the lands and grooves extend from the chamber to the muzzle end.

3. The firearm barrel of claim 1 wherein the bore has a constant cross-sectional profile along its length.

4. The firearm barrel of claim 1 wherein the bore has a diameter of between 0.17 inch and 0.50 inch.

5. The firearm barrel of claim 1 wherein the chamber is sized to receive a cartridge having a bottlenecked case.

6. The firearm barrel of claim 1 wherein the elongated body has a length less than 16 inches.

7. A firearm comprising:

a frame;

a barrel connected to the frame;

the barrel comprising an elongated body defining a bore and defining a bore axis;

the barrel having a length of less than 18 inches;

the barrel defining a breech end and an opposed muzzle end;

a chamber defined in the breech end and contiguous with the bore;

wherein the chamber is configured to receive ammunition having a central primer registered with the bore axis;

the bore having an interior surface having a plurality of alternating lands and grooves;

the grooves being surfaces separated from the bore axis by first radius;

the lands being surfaces separated from the bore axis by second radius less than the first radius; and the lands and grooves being straight elements parallel to the bore axis, such that no spin is imparted to a projectile propelled down the bore.

8. The firearm of claim 7 wherein the lands and grooves extend from the chamber to the muzzle end.

9. The firearm of claim 7 wherein the bore has a constant cross-sectional profile along its length.

10. The firearm of claim 7 wherein the bore has a diameter of between 0.17 inch and 0.50 inch.

11. The firearm of claim 7 wherein the chamber is sized to receive a cartridge having a bottlenecked case.

12. The firearm of claim 7 wherein the barrel has a length less than 16 inches.

* * * * *